United States Patent [19]

Schünmeier et al.

[11] 4,155,515

[45] May 22, 1979

[54] WINDING STATION

[75] Inventors: Herbert Schünmeier; Wilfried Kurth, both of Dusseldorf; Reinhard Hehner, Mulheim; Willi Heymanns, Buettgen, all of Fed. Rep. of Germany

[73] Assignee: Jagenberg Werke Aktiengesellschaft, Dusseldorf, Fed. Rep. of Germany

[21] Appl. No.: 900,689

[22] Filed: Apr. 27, 1978

[30] Foreign Application Priority Data

Jun. 3, 1977 [DE] Fed. Rep. of Germany ..... 2725176

[51] Int. Cl.[2] ..... B65H 35/02

[52] U.S. Cl. ..... 242/56.2

[58] Field of Search ..... 242/56.2, 56.3, 56.4, 242/56.5, 56.6, 56.7, 56.8

[56] References Cited

U.S. PATENT DOCUMENTS

| | | | |
|---|---|---|---|
| 3,536,273 | 10/1970 | Hawkins | 242/56.7 |
| 3,750,973 | 8/1973 | Walters | 242/56.2 |
| 3,949,948 | 4/1976 | Tomma | 242/56.2 |
| 3,998,399 | 12/1976 | Held | 242/56.2 |

*Primary Examiner*—Edward J. McCarthy

*Attorney, Agent, or Firm*—Sprung, Felfe, Horn, Lynch & Kramer

[57] ABSTRACT

A winding station for webs comprises a plurality of knives disposed side by side and which are laterally displaceable along the width of a web to predetermined positions for slitting the web into a plurality of narrower webs. A guide roller is disposed downstream of the knife and a plurality of pairs of winding frames are disposed in at least two rows in a staggered relationship on opposite sides of the guide roller. The winding frames are laterally displaceable into positions corresponding to the positions of the knives by means of servomotors. The winding frames bear projecting chucks for receiving winding spools thereon and gripper cones over the winding chucks which are expandable radially by axial displacement. A program control effects the positioning of the winding frames to align the gripper cones with the knives. A program control utilizes the information of the sensing of the lateral position of the knives for first effecting the displacement of at least one winding frame of each pair to correct the position corresponding to the associated knives and thereafter effecting the displacement of the other winding frame of each pair against the one winding frame until the winding spool that is to be mounted is gripped by the axially moving and simultaneously expanding gripper cones. As a result of this movement, the lateral position of the gripper cones for some pairs of the winding frames are shifted off center.

2 Claims, 9 Drawing Figures

FIG. 5 III

WINDING STATION

BACKGROUND

The invention relates to a winding station for webs of goods, consisting of a plurality of knives disposed side by side and displaceable to predetermined positions for slitting a web of material into a plurality of narrower webs, and of pairs of winding frames which are disposed in two rows in a staggered arrangement especially on opposite sides of a guide roller and are displaceable by servomotors to positions corresponding to the positions of the knives, and which bear projecting chucks for holding winding spools.

In a known winding station of this kind the chucks consist of cylindrical mandrels provided with flanges. The spools are placed on these cylindrical mandrels and gripped between their flanges. Since the position of a winding spool is determined by the position of one of the flanges of each winding frame and the position of this flange does not change for the spool mounting procedure, i.e., it retains its predetermined position in relation to the knives, a corrective positioning is not necessary after the spool has been mounted. It is a disadvantage, however, that the winding spools must fit precisely on the cylindrical mandrels in order to remain centered.

THE INVENTION

The invention is addressed to the problem of creating a winding station which on the one hand will assure a centered mounting of the winding spools and which, on the other hand, will automatically allow for the resulting axial position of the winding spools on the chucks in the positioning of the chucks.

This problem is solved in accordance with the invention, in a winding station of the initially named kind, by means of gripper cones disposed on the chucks, which expand radially by axial displacement, and by a control means for the positioning of the winding frames, which consists of a program control which, depending on the position values supplied by transmitters from the knives, shifts at least one winding frame of each pair of winding frames to the correct position corresponding to the associated knife and then shifts the other winding frame against the first winding frame until the spool to be mounted is gripped on the chucks, and which furthermore consists of a distance sensing means associated with each pair of winding frames, which signals to the program control the distance by which the gripper cone of the one winding frame has been displaced on the chuck, the program control then moving this pair of winding frames by the axial displacement of the gripper cone from its original correct position, for the purpose of correcting the position of this pair of winding frames.

In the winding station of the invention, the assurance is given that the winding spools are gripped centrally on the chucks. The axial displacement of the chucks in relation to the originally preset position corresponding to the associated knives is compensated by shifting each pair of winding frames.

In one embodiment of the invention, the shifting motor of the one winding frame of a pair is a direct-current motor with a distance sensing means, especially a stepping motor, and the other servomotor is an asynchronous motor with distance sensing means, especially a rotating field electromagnet. With such drives the positions can be reached precisely, and on the other hand they can be displaced against one another and the gripping tension between the spool and the cone can be sustained without overloading and without an excessive complication of the control.

BRIEF DESCRIPTION OF THE DRAWINGS

The invention will be explained below with the aid of a drawing representing an embodiment thereof. In particular.

DETAILED DESCRIPTION OF THE INVENTION

Figure 1:
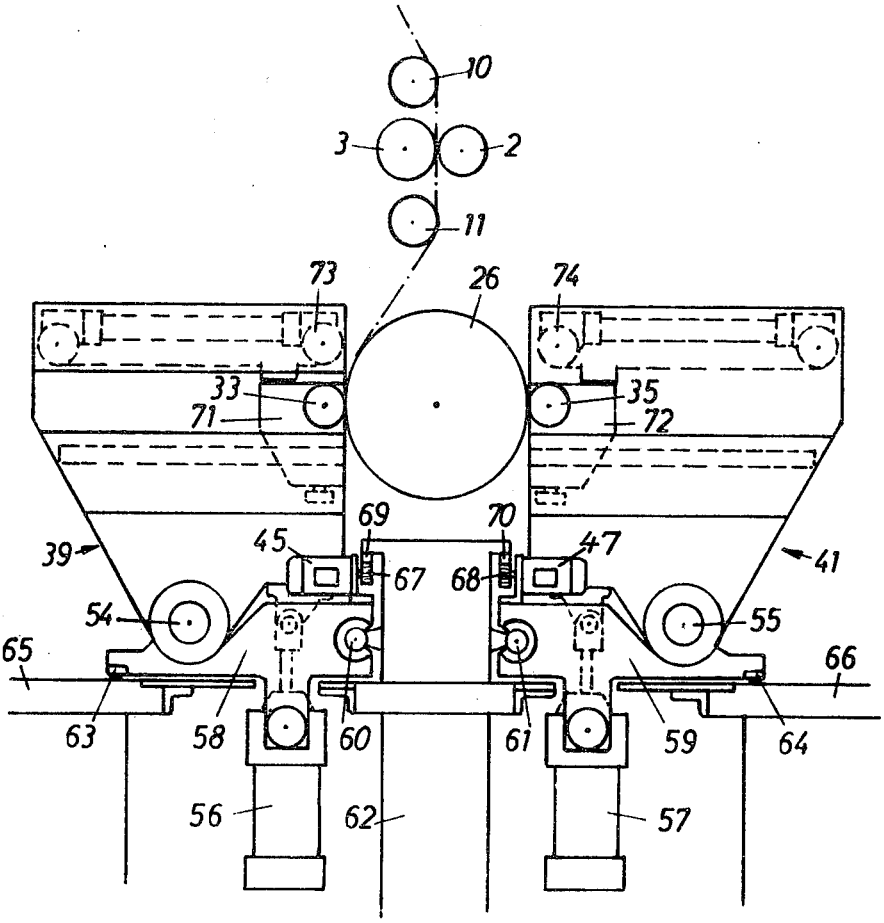
FIG. 1 shows a diagrammatic side elevational view of a winding station, FIG. 2 a diagrammatic top plan view of the winding station of FIG. 1, FIG. 3 an axial cross section of a spool mounting cone, FIG. 4 a block circuit diagram of a control apparatus for the winding station.
Figure 2:
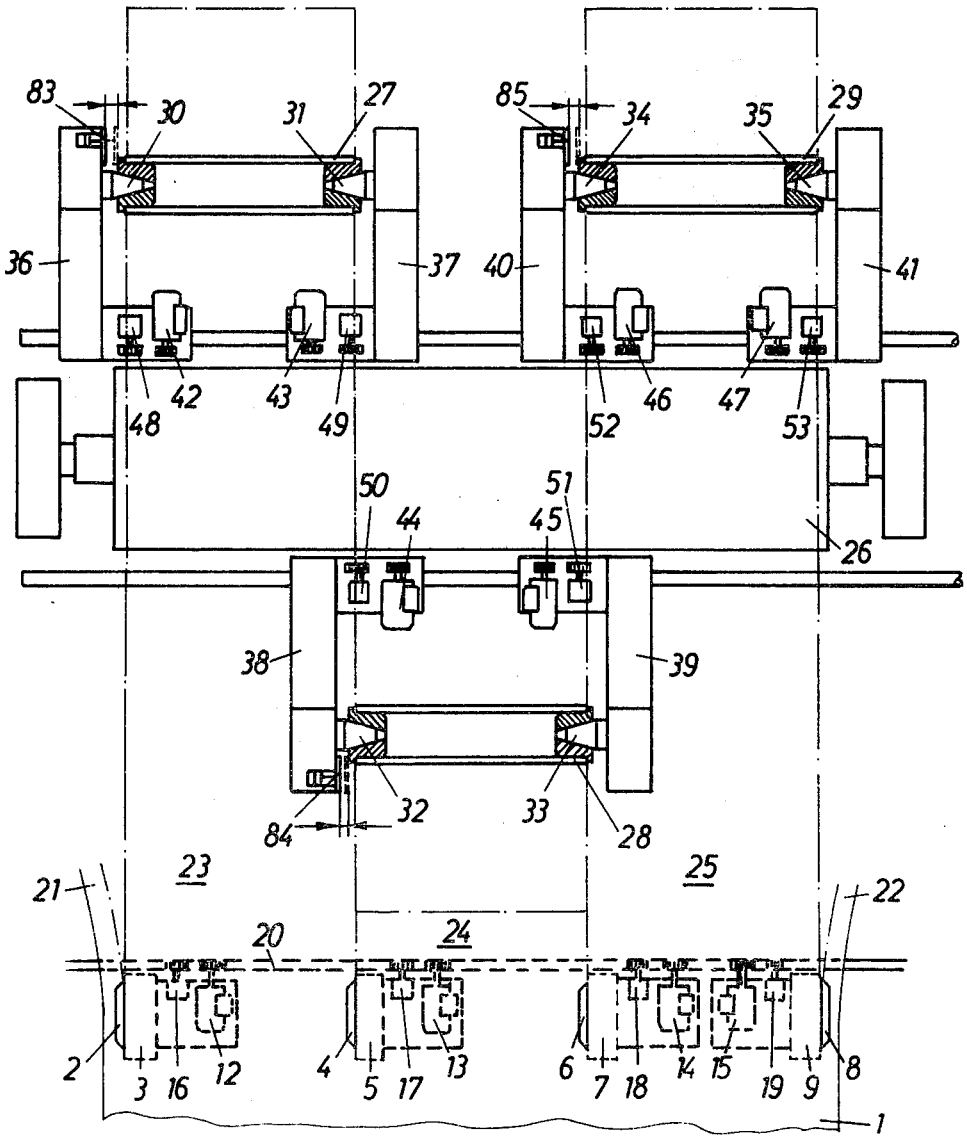

As shown in FIGS. 1 and 2, a web of material 1 of great breadth, a paper web for example, is fed from a roll, which is not represented, to a set of knives 2–9, the knives of each pair being disposed on opposite sides of the web 1. On the infeed side of each knife pair there is provided a guide roller 10. Another guide roller 11 is provided on the outfeed side of each knife pair. With each knife pair there is associated an adjusting mechanism consisting of a motor 12–15 and distance sensing means 16–19 whereby the knife pairs can be moved to the desired positions. For this purpose pinions associated with the motors 12–15 and the distance sensing means 16–19 engage a rack 20. The two outer knife pairs 2–3, and 8–9, serve for the edge trimming of the web 1 and to this end they shear narrow marginal strips 21–22, from the web 1, while the middle knife pairs 4–5 and 6–7 divide the web 1 into narrower webs 23, 24 and 25.

Underneath the knife pairs 2–9 there is situated a large, driven roller 26 over which the narrow webs 23–25 are delivered to winding spools 27–29. The winding spools 27 and 29 are disposed in alignment with one another on the one side of the roller 26, while the winding spool 28 is disposed in a staggered relationship on the other side of the roller 26, so that the corresponding outside edges of the spools are in alignment with the cut edges of the webs of material.

Each winding spool 27–29 is gripped at both ends by the cones of projecting chucks 30–35. The chucks 30–35 are borne by winding frames 36–41. The winding frames 36–41 are displaceable parallel to the roller 26 by servomotors 42–47 with corresponding distance sensing means 48–53.

The arrangement of the winding frames 39 and 41 is represented in detail in FIG. 1. Each of the winding frames 39 and 41 is mounted on a carriage 58 and 59, respectively, so as to be able to be rocked about an axis 54 and 55, away from the roller 26, by hydraulic jacks 56 and 57, respectively. Each carriage 58 and 59 is displaceably mounted on a rail 60 and 61, respectively, of a central pedestal 62, and on runners 63 and 64 resting on outer pedestals 65 and 66, respectively. The movement of the frames 39 and 41 is accomplished by the above-mentioned servomotors 45 and 47 which by means of pinions 67 and 68 engage racks 69 and 70, respectively, on the central pedestal 62.

In each winding frame 39, 41, the chuck 33, 35, is displaceable on a carriage 71, 72, radially to the roller 26. By means of a cable drive 73, 74, the spool 28, 29, gripped by the chucks 33, 35, is held with pressure against the surface of the roller 26 and made to rotate thereby. The arrangement of the other winding frames 36 and 37 is similar.

Figure 3:
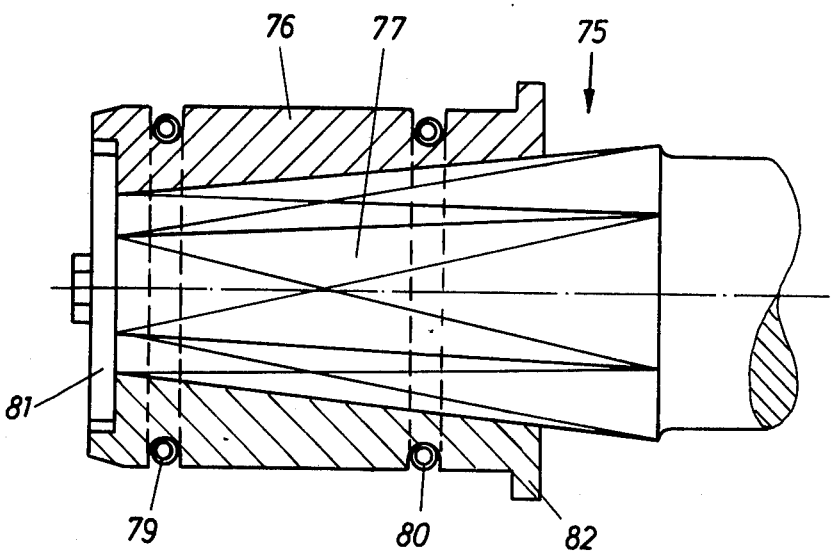
Figure 4:
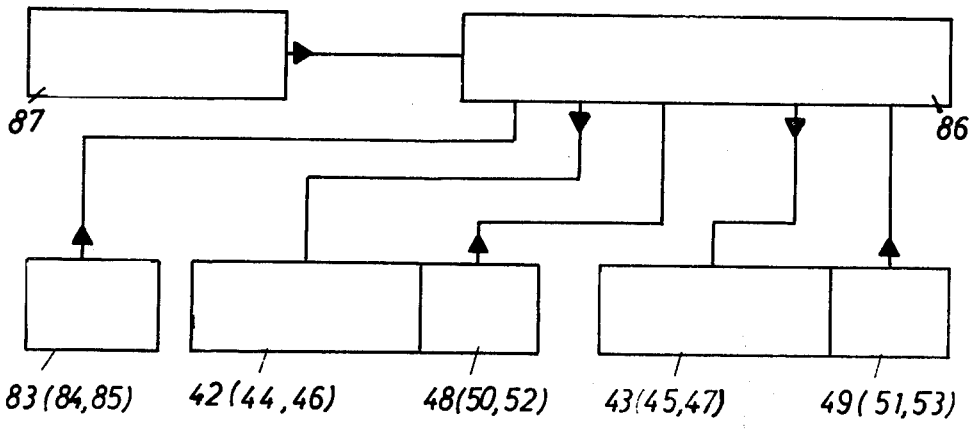

A chuck is represented in FIG. 3. It consists of an internal cone 75 and shell-like parts 76 which are held together and urged against the end stop 81 by tension springs 79 and 80. The internal cone 75 is polygonal in cross section and has flats 77 which hold the shell-like parts concentrically. If a winding spool is placed on it and abuts against the flange 82, the shell-like parts 76 are shifted axially on the cone 75 and spread apart until the spool is tightly held on the shell-like parts 76.

Figures 5, 5I, 5V:
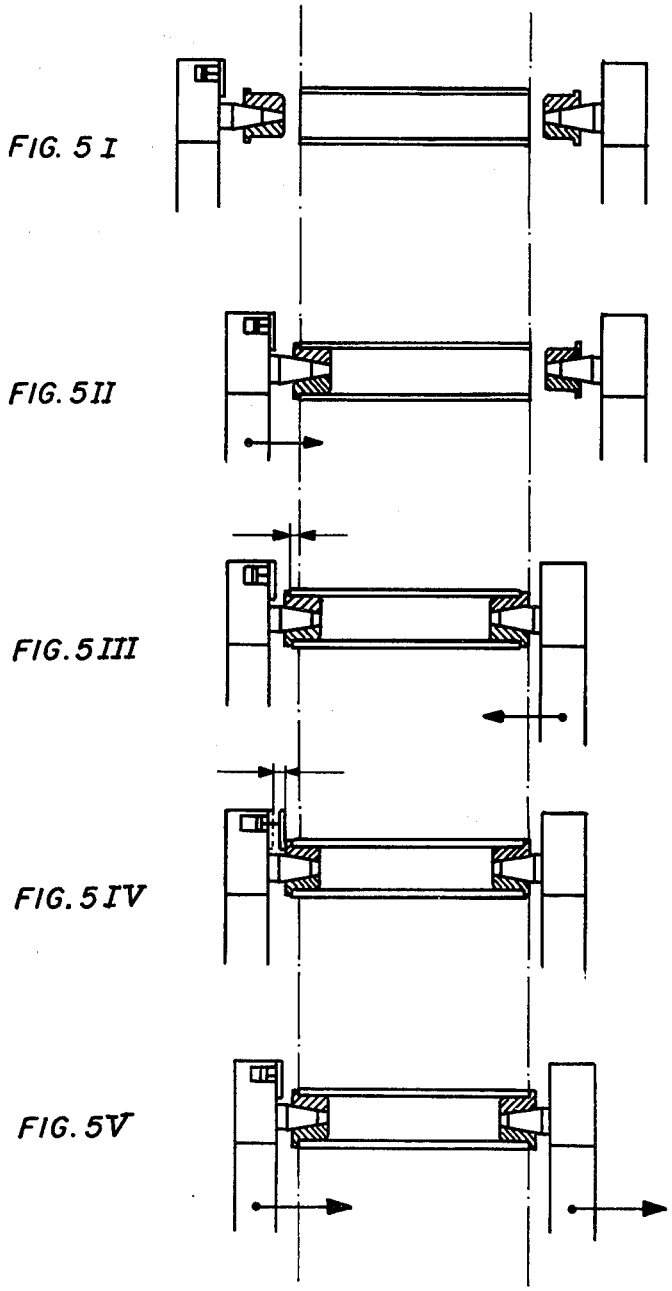
FIGS. 5I–5V show various positions of the winding frames during the the positioning action performed by the control means.

The positioning of the winding frames 36 to 41 in accordance with the position of the knife pairs 2 to 9 is accomplished in the following manner:

The program control 86 is operated by the positioning input 87. The program control shifts the knife pairs 2 to 9 by means of the motors 12, 13, 14 and 15 to the given positions. Furthermore, the program control 86 operates the servomotors 42–47 in the manner represented in FIG. 5 to shift the winding frames 36, 38 and 40 to position I in which the spools can be mounted on the chucks 30–35. The program control 86 then operates the servomotors 42, 44 and 46 to shift the corresponding winding frames 36, 38 and 40 to the positions corresponding to knife pairs 2 to 9. In this position II, the inside of the flange 82 of each chuck is in line with the cut edges of the webs 23 to 25 indicated by the dash-dotted lines. This can also be seen in FIG. 5. After intermediate position II, intermediate position III is reached when the program control 86 operates the servomotors 43, 45 and 47 to shift the other winding frames 37, 39 and 41 towards the winding frames 36, 38 and 40. In this position III, the winding spools are tightened. The shell-like parts 76 shift on the cone 75, and thus the previously aligned inside of the flange 82 also shifts towards the cut edge of the web which is indicated by the dash-dotted line. The misalignment that results from this is shown on the left side in position III. To correct this misalignment of the winding spool from the position in line with the web, the distance involved is measured by the sensing means 83–85 as shown in position IV.

The sensing means 83 to 85 transmit the distance to the program control 86 where it is compared with the correct distance. The program control 86 computes the amount by which the winding frames 36, 38 and 40 have to be shifted so that the insides of the flanges 82 and hence also the edges of the winding spools 27, 28 and 29 will again be in line with the cut edges of the web. The servomotors 42–47 then receive a corresponding positioning signal. Their distance sensing means 48–53 provide the feedback signal, so that the program control 86 stops the servomotors 42–47 as soon as the desired position V is reached.

The use of a rotating field electromagnet for the servomotor 43, 45 and 47 is advantageous because even when stationary these motors maintain a certain torque without become overloaded. This means that a pair of winding frames 36–41 can be shifted in common by energizing the servomotors 42, 44 and 46, the latter acting against the torques of motors 32, 45 and 47. This facilitates the simultaneous displacement of the winding frames 36–41 pertaining to one pair, while sustaining the gripping action on the winding spools 27, 28 and 29. In this case the servomotors 43, 45 and 47 do not have to be operated through their spacing transducers 49, 51 and 53 and program control 86.

It will be appreciated that the instant specification and claims are set forth by way of illustration and not limitation, and that various modifications and changes may be made without departing from the spirit and scope of the present invention.

What is claimed is:

1. A winding station for webs comprising a plurality of knives disposed side by side, means for laterally displacing same along the width of a web to predetermined positions for the slitting of the web into a plurality of narrower webs, a guide roller downstream of the knives, a plurality of pairs of winding frames disposed in at least two rows in a staggered relationship on opposite sides of the guide roller, means for laterally displacing the pairs of winding frames into positions corresponding to the positions of the knives comprising servomotors, and wherein the winding frames bear projecting chucks for receving winding spools thereon, gripper cones disposed on the chucks and which are expandable radially by axial displacement, and control means for controlling the positioning of the winding frames to align the gripper cones with the knives, comprising lateral distance sensing means for each of the knives and each pair of the winding frames and means receptive of the output of the distance sensing means for the knives for first effecting the displacement of at least one winding frame of each pair to the correct position corresponding to the associated knives and thereafter effecting the displacement of the other winding frame of each pair against the one winding frame until the winding spool that is to be mounted is gripped by the axially moving and simultaneously expanding gripper cones whereby the lateral position of the gripper cones for pairs of winding frames are shiftable off center, and receptive of the output of the distance sensing means associated with each pair of winding frames to effect the displacement of those pairs of winding frames towards their original correct position by the axial amount of the shift of the gripper cones.

2. The winding station according to claim 1, wherein the servomotor of the one winding frame comprises a direct-current stepping motor and the distance sensing means therefor comprises a distance transmitter and the servomotor for the other winding frame comprises a rotating field magnet asynchronous motor and the distance sensing means therefor comprises a distance transmitter.

* * * * *